US012320606B2

(12) United States Patent
Strechinski et al.

(10) Patent No.: US 12,320,606 B2
(45) Date of Patent: Jun. 3, 2025

(54) MODULAR PISTOL GRIP

(71) Applicant: ARSENAL COLLECTION s.r.o., Karlovy Vary (CZ)

(72) Inventors: Dmitri Strechinski, Tel-Aviv (IL); Marcin Adam Galazka, Ruda Slaska (PL)

(73) Assignee: ARSENAL COLLECTION s.r.o., Karlovy Vary (CZ)

( * ) Notice: Subject to any disclaimer, the term of this patent is extended or adjusted under 35 U.S.C. 154(b) by 0 days.

(21) Appl. No.: 18/491,458

(22) Filed: Oct. 20, 2023

(65) Prior Publication Data

US 2024/0302117 A1 Sep. 12, 2024

Related U.S. Application Data

(60) Provisional application No. 63/450,157, filed on Mar. 6, 2023.

(51) Int. Cl.

| | |
|---|---|
| ***F41C 23/14*** | (2006.01) |
| ***F41A 3/66*** | (2006.01) |
| ***F41C 23/10*** | (2006.01) |

(52) U.S. Cl.
CPC ..... *F41A 3/66* (2013.01); *F41C 23/10* (2013.01); *F41C 23/14* (2013.01)

(58) Field of Classification Search
CPC ..... F41C 23/10; F41C 23/2314; F41C 23/16
See application file for complete search history.

(56) References Cited

U.S. PATENT DOCUMENTS

| | | | | |
|---|---|---|---|---|
| 2013/0139426 | A1* | 6/2013 | Baxley | F41C 23/10 42/71.02 |
| 2021/0172691 | A1* | 6/2021 | Hsu | F41A 9/71 |
| 2024/0027162 | A1* | 1/2024 | Karchon | F41C 23/10 |

* cited by examiner

*Primary Examiner* — J. Woodrow Eldred
(74) *Attorney, Agent, or Firm* — Lowenstein Sandler LLP

(57) ABSTRACT

A modular pistol grip includes one or more modular extenders configured to couple to a main grip. The modular pistol grip further includes an interchangeable backstrap configured to couple to the main grip and the one or more modular extenders. The one or more modular extenders are configured to extend a length of the modular pistol grip when coupled to the main grip.

20 Claims, 5 Drawing Sheets

MODULAR PISTOL GRIP

RELATED APPLICATION

This application claims the benefit of U.S. Provisional Application No. 63/450,157, filed Mar. 6, 2023, the contents of which are hereby incorporated by reference in their entirety.

TECHNICAL FIELD

The present disclosure relates to firearm grips, and, more particularly, a modular pistol grip.

BACKGROUND

Firearms include a portion for a user to grip (e.g., hold, etc.) the firearm. Handguns (e.g., pistols, etc.) include a grip that a user can hold with one or both hands. Such a grip is often called a "pistol grip." Long guns, such as rifles and shotguns, can also have a pistol grip for a user to hold with one or both hands.

BRIEF DESCRIPTION OF THE DRAWINGS

The present disclosure is illustrated by way of example, and not by way of limitation in the figures of the accompanying drawings.

DETAILED DESCRIPTION OF EMBODIMENTS

Figure 1:
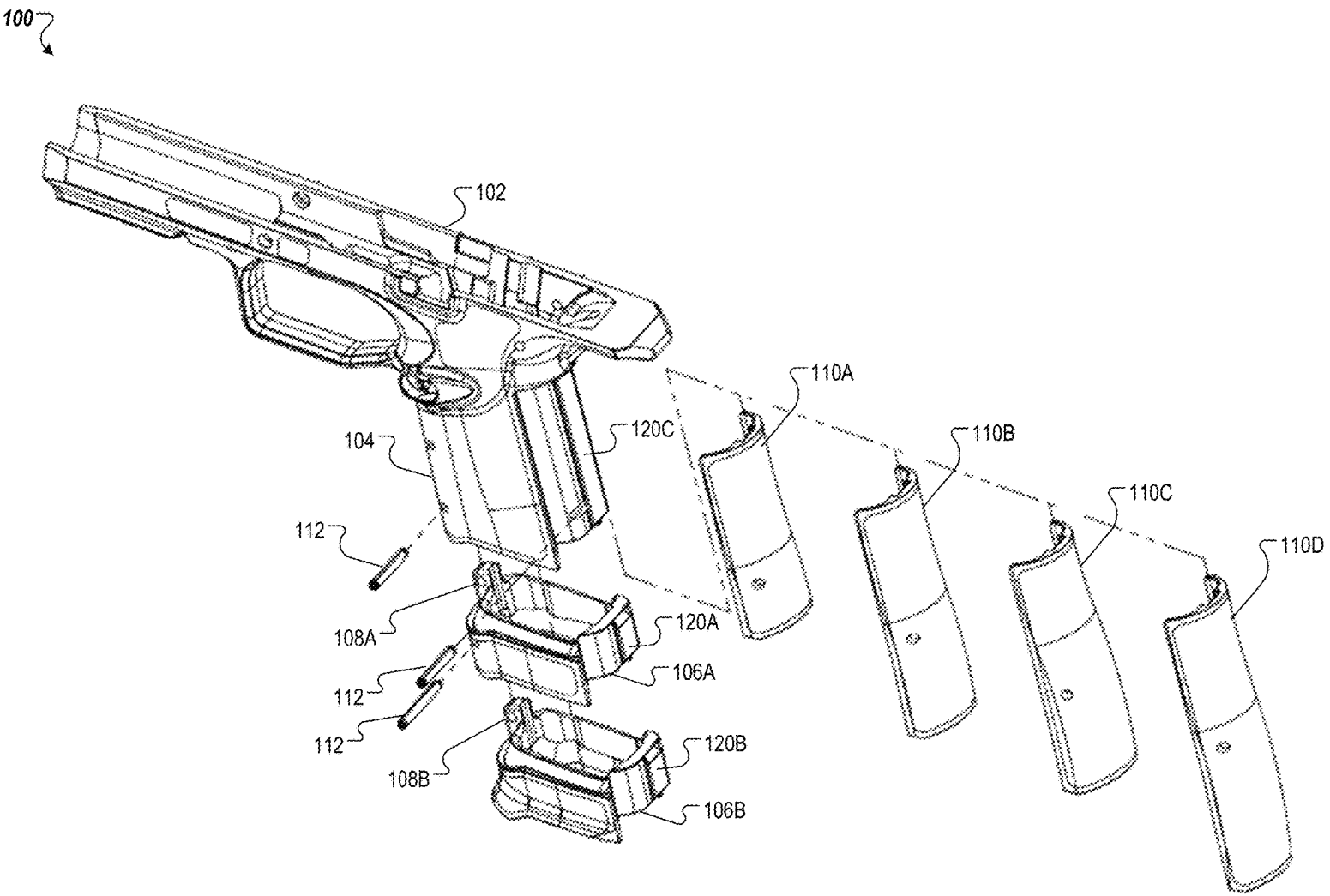
FIG. 1 illustrates a perspective exploded view of a modular pistol grip assembly, according to certain embodiments.

Embodiments described herein are related to a modular pistol grip (e.g., for firearms, etc.).

Firearms commonly include features a user can hold (e.g., with their hands). Such features allow the user to use the firearm safely and effectively. Specifically, handguns (e.g., such as pistols, etc.) include a "pistol grip" that can be held by one or both of a user's hands. A pistol grip may be a protruding handle on the bottom of a firearm. The pistol grip of a handgun conventionally protrudes from the bottom at or near the rear portion of the handgun frame. A pistol grip allows a user to hold their hand at a more vertical (and thus more ergonomic) angle. A pistol grip allows a user to grip the firearm with their hand while also allowing the user to easily reach and manipulate the trigger with their trigger finger. Some long guns (e.g., such as rifles or shotguns, especially modern sporting rifles, etc.) also include a "pistol grip" that is often gripped by a user's dominant hand while the user's non-dominant hand holds a fore-grip to steady the firearm. In some instances, the fore-grip can also be a "pistol grip." Pistol grips can also be included on a variety of tools such as hand saws, power saws, power drills, pneumatic tools, paint sprayers, nail guns, etc.

Conventional pistol grips suffer from having fixed geometry (e.g., size, length, shape, etc.). For example, a user with small hands may struggle to effectively use a pistol grip designed for large hands or may find the pistol grip uncomfortable. Pistol grips designed for large hands may have large dimensions, such as thickness and/or length, which cannot be effectively used with small hands. In a similar example, a user with large hands may find a pistol grip designed for small hands uncomfortable. Pistol grips designed for small hands may have small dimensions, such as thickness and/or length, which cannot be effectively or comfortably used with large hands.

In a further example, handguns with small pistol grips (e.g., such as handguns designed for concealment, etc.) may be difficult to shoot quickly and/or accurately due to the small size of the pistol grips. A user may be unable to effectively grip a small pistol grip to control the handgun, especially under recoil. This can make aiming difficult and can increase the difficulty in which follow-up shots can be accurately made. Additionally, handguns with small grips may amplify the felt recoil to a user's hands. Small grips present a correspondingly small area for the recoil impulse to be transferred to the user's hands, thus causing more discomfort to the user when compared to handguns with large grips. Because handguns with small pistol grips are often small and light (e.g., having comparatively less mass than larger handguns, etc.), the problem of felt recoil is amplified. Often, users or owners of handguns with small pistol grips choose to use or train with such handguns infrequently due to the discomfort and difficulty associated with small pistol grips (e.g., uncomfortable to hold or use, discomfort due to felt recoil, etc.). Users often then choose to incur the expense of buying a more suitable alternative handgun and/or suffer from a lack of proficiency when using the handgun with a small pistol grip.

The systems, devices, and methods of the present disclosure provide a modular pistol grip to overcome the shortcomings of conventional pistol grips described above. The modular pistol grip described herein can be configured and/or reconfigured quickly and easily using a minimum number of tools. In some embodiments, the modular pistol grip allows a user to configure the grip size and/or length by attaching or removing one or more modular extenders (e.g., modular extensions, extension pieces, etc.) and/or interchanging a backstrap. In some embodiments, a modular pistol grip includes one or more modular extenders to extend the length of the pistol grip. A first modular extender can be removably coupled to a main grip (e.g., a main portion of the grip, the portion of the grip fastened to the firearm, etc.). A second modular extender can be removably coupled to the first modular extender. Coupling one or more modular extenders to the main grip can increase the effective length of the pistol grip. This can be helpful where the original length of the main grip is short, such as on small handguns and/or handguns designed for concealment, etc. Extending the length of the pistol grip can also be helpful where a user has large hands. In some embodiments, multiple modular extenders can be coupled together to increase the length of the pistol grip.

In some embodiments, the modular pistol grip includes an interchangeable backstrap to couple to the main grip and/or the one or more modular extenders. The backstrap may form the rearmost portion of the modular pistol grip. The backstrap may fit into the palm of a user's hand when gripped. In some embodiments, the interchangeable backstrap covers the joints on the rear of the modular pistol grip between the one or more modular extenders and/or the main grip portion so that there are no gaps that could possibly pinch a user's hand. The backstrap is interchangeable between a first backstrap and one or more second backstraps. For example, a first backstrap having a first thickness and/or a first length can be coupled to one or more modular extenders and/or the main grip. The first backstrap can be replaced with a second backstrap having a different second thickness and/or a different second length.

In some embodiments, the interchangeable backstrap has an associated length with respect to the length of the modular pistol grip. For example, the length of the interchangeable backstrap corresponds to the length of the modular pistol grip with the one or more modular extenders. Where one modular extender is used, a backstrap having a length corresponding to the one modular extender is coupled to the modular extender and/or to the main grip. Where two modular extenders are used, a backstrap having a length corresponding to the two modular extenders is coupled to the two modular extenders and/or to the main grip. A backstrap having a length corresponding to only the main grip may be coupled to the main grip where no modular extenders are used.

The modular pistol grip of the present disclosure may have advantages over conventional pistol grips. In some embodiments, the modular pistol grip described herein can be configured and/or reconfigured (e.g., by a user) to have different lengths to suit various hand sizes or situations. For example, modular extenders can be added to a pistol grip to increase the length of the pistol grip for larger hands, increase control of a firearm during shooting, and/or reduce felt recoil. The modular extenders can similarly be removed to reduce the length of the pistol grip to ease concealment of the firearm and/or to accommodate small hands. In some embodiments, the interchangeable backstrap of the pistol grip described herein can be interchanged with backstrap portions having various thicknesses and/or lengths to fit various sizes of users' hands and/or to correspond with the extended length of the pistol grip when modular extenders are added. In some embodiments, the pistol grip described herein adds to the versatility of a particular firearm by providing multiple grip configurations (e.g., multiple lengths, thicknesses, etc.). By using the modular pistol grip described herein according to some embodiments, a user can tailor the grip length and/or size and can utilize multiple different grip lengths and/or grip sizes without incurring the expense of additional firearms.

FIG. 1 illustrates a perspective exploded view of a modular pistol grip assembly 100, according to certain embodiments. In some embodiments, a modular pistol grip includes one or more modular extenders 106A-B and an interchangeable backstrap 110A-110D. The modular extenders 106A-B may be modular grip extensions to increase the length of the modular grip. In some embodiments, the one or more modular extenders 106A-B may couple to the bottom end of a main grip 104. Main grip 104 may protrude from firearm frame 102. As illustrated in FIG. 1, frame 102 is the frame of a semi-automatic handgun. In some embodiments, frame 102 can be the frame of a rifle (e.g., such as the frame of a modern sporting rifle) or the frame of a shotgun.

In some embodiments, a first modular extender 106A can couple to the bottom of main grip 104. Main grip 104 may be a main grip portion of the modular pistol grip. Main grip 104 may be configured to receive the first modular extender 106A to extend the length of the modular pistol grip. In some embodiments, a male protrusion 108A protruding from the top of modular extender 106A fits into a female receptacle formed in the bottom of the main grip 104. The male protrusion 108A may be tapered, and the female receptacle may have a corresponding taper to receive the male protrusion 108A. The male protrusion 108A may protrude from the top of modular extender 106A near a front side of the modular extender 106A. The first modular extender 106A may be configured to receive a second modular extender 106B to further extend the length of the modular pistol grip. In some embodiments, a second modular extender 106B can couple to the bottom of the first modular extender 106A. In some embodiments, a male protrusion 108B protruding from the top of modular extender 106B fits into a female receptacle formed in the bottom of modular extender 106A. In some embodiments, the modular extenders 106A-B extend the length of the modular pistol grip when coupled to the main grip 104.

In some embodiments, the modular extenders 106A-B are removably attached to the main grip 104 by pins 112. For example, when the first modular extender 106A is placed in position to couple with main grip 104, a through-hole formed in the protrusion 108A aligns with a through-hole formed in the main grip 104. A pin 112 can be driven through the through-holes to secure the first modular extender 106A to the main grip 104. Similarly, when the second modular extender 106B is placed in position to couple with the first modular extender 106A, a through-hole formed in the protrusion 108B aligns with a through-hole formed in the first modular extender 106A. A pin 112 can be driven through the through-holes to secure the second modular extender 106B to the first modular extender 106A. In some embodiments, pins 112 are roll pins.

In some embodiments, the main grip 104 and the modular extenders 106A-B include a cavity (e.g., a magazine well, etc.) to receive a firearm magazine. In some embodiments, the main grip 103 and the modular extenders 106A-B together form a cavity to receive a magazine. The magazine (not illustrated) may be configured to removably couple to the main grip 104 and/or frame 102. When coupled, the magazine may be at least partially disposed within the main grip 104. The modular extenders 106A-B and the main grip 104 may surround the magazine on at least four sides when the magazine is inserted into the magazine well. When inserted into the magazine well, the magazine may extend past the bottom of the main grip 104 to be substantially flush with the bottom of the first modular extender 106A or the bottom of the second modular extender 106B. In some embodiments, the bottom modular extender (e.g., modular extender 106B shown in FIG. 1) may be flared to increase the size of the magazine well for easier and/or faster insertion of the magazine into the magazine well. In some embodiments, the modular extenders 106A-B have flush walls (e.g., parallel walls, no flare, etc.) to be more easily concealed (e.g., under clothing, etc.).

In some embodiments, the interchangeable backstraps 110A-D are configured to couple to the main grip 104 and/or modular extenders 106A-B. In some embodiments, a dovetail groove formed on the inner portion (e.g., the front portion, etc., see FIGS. 2A-2B) of the interchangeable backstraps 110A-D fits with the dovetail tongues 120A-C formed on the back of the modular extenders 106A-B and the main grip 104. The interchangeable backstraps 110A-D can be attached to the main grip 104 and/or to the modular extenders 106A-B by aligning the dovetail groove with the dovetail tongue(s) and sliding the interchangeable backstraps 110A-D up on the main grip 104 into position. In some embodiments, a through hole in the interchangeable backstraps 110A-D aligns with a through hole in the main grip 104 when the interchangeable backstraps 110A-D are in the installed position. A pin 112 can be driven through the through-holes to removably secure the interchangeable backstraps 110A-D to the main grip.

Only one of the interchangeable backstraps 110A-D can be installed onto the main grip 104 at a time. In some embodiments, each of the interchangeable backstraps 110A-D has a different length and/or a different thickness. The lengths of the interchangeable backstraps 110A-D may correspond with the extended length of the modular pistol grip. For example, the length of interchangeable backstrap 110A may correspond to the length of the modular pistol grip without any modular extenders installed on the main grip 104. The length of interchangeable backstrap 110B may correspond to the length of the modular pistol grip with only the first modular extender 106A installed on the main grip 104. The length of interchangeable backstrap 110C may correspond to the length of the modular pistol grip with both the first modular extender 106A and the second modular extender 106B installed on the main grip 104. The length of interchangeable backstrap 110D may correspond to the length of the modular pistol grip with both the first and second modular extenders 106A-B, along with a third modular extender (not illustrated) installed on the main grip 104. In some embodiments, the length of an interchangeable backstrap has an associated length with respect to the extended length of the modular pistol grip.

In some embodiments, each of the interchangeable backstraps 110A-D have different thicknesses. The different thicknesses of the interchangeable backstraps 110A-D may be to fit different-sized hands (e.g., of users, etc.). For example, interchangeable backstrap 110A may have a first thickness, interchangeable backstrap 110B may have a second thickness different from the first thickness, interchangeable backstrap 110C may have a third thickness different from the first and second thicknesses, etc.

In some embodiments, each of the interchangeable backstraps 110A-D is interchangeable with any of the other interchangeable backstraps 110A-D. For example, backstrap 110A is interchangeable with any of backstraps 110B-D, etc.

In some embodiments, the modular extenders 106A-B and/or the interchangeable backstraps 110A-D are made of a material that is at least somewhat flexible. In some embodiments, the modular extenders 106A-B and/or the interchangeable backstraps 110A-D are made of a polymer material. In some embodiments, the modular extenders 106A-B and/or the interchangeable backstraps 110A-D are made of a fiber-reinforced polymer resin, such as glass fiber-reinforced polyamide resin. In some embodiments, the flexible nature of the modular extenders 106A-B and/or the interchangeable backstraps 110A-D allow the modular extenders 106A-B to lock with respect to the lower portion of the interchangeable backstraps 110A-D when installed.

Figure 2B:
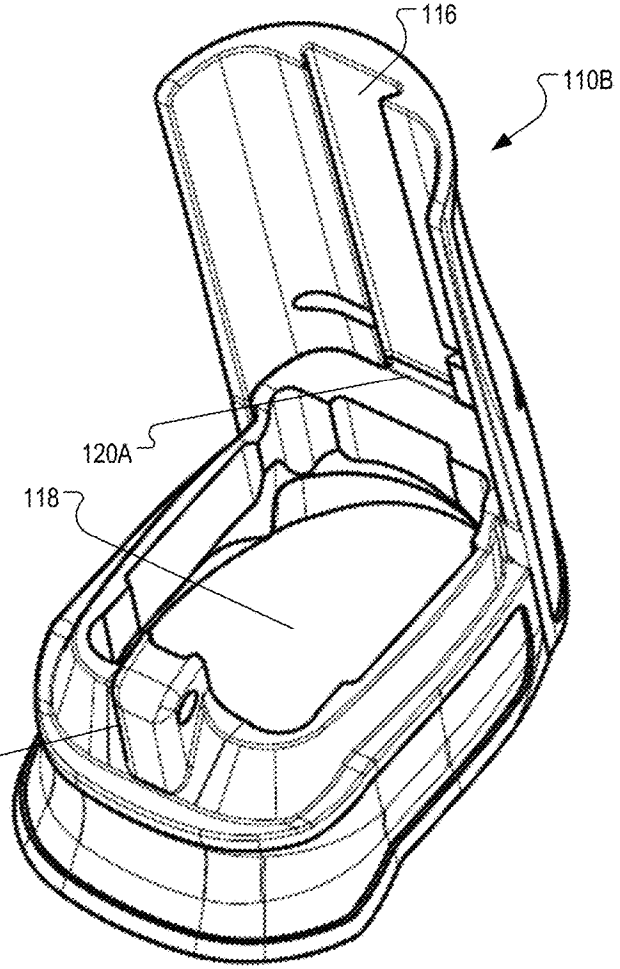
FIGS. 2A-2B illustrate perspective views of a portion of a modular pistol grip assembly, according to certain embodiments.
Figure 2A:
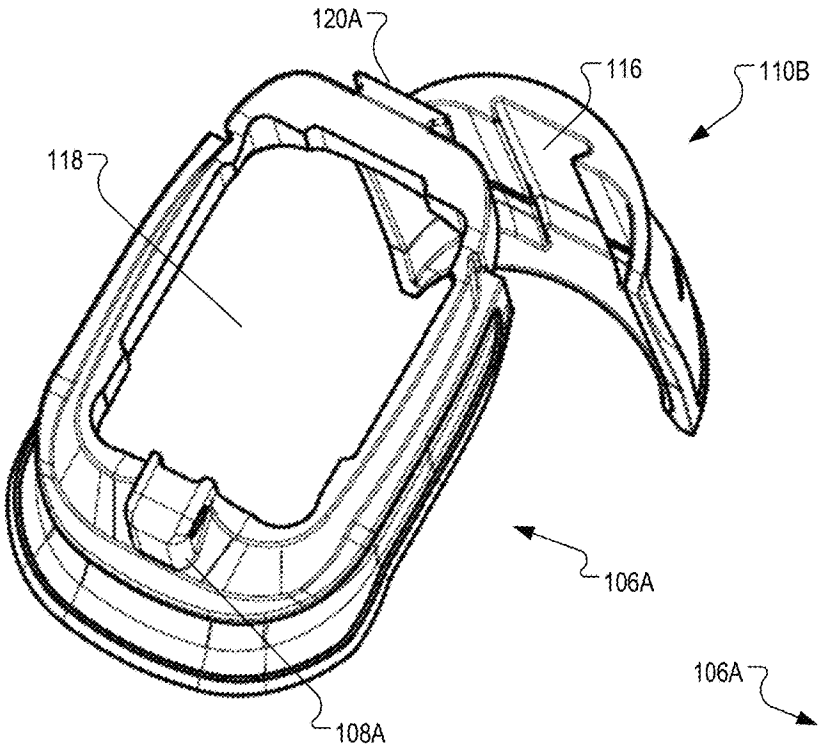

FIGS. 2A-2B illustrate perspective views of a portion of a modular pistol grip assembly, according to certain embodiments. FIG. 2A shows a disassembled perspective view of modular extender 106A and interchangeable backstrap 110B. FIG. 2B shows an assembled perspective view of modular extender 106A and interchangeable backstrap 110B. In some embodiments, interchangeable backstrap 110B is attached to modular extender 106A by a tongue and groove arrangement. In some embodiments, a dovetail groove formed in a surface of the interchangeable backstrap 110B corresponds to a dovetail tongue 120A protruding from a rear surface of modular extender 106A. The dovetail tongue 120A may fit into the dovetail groove 116 to secure the interchangeable backstrap 110B to the modular extender 106A. In some embodiments, to attach the interchangeable backstrap 110B to the modular extender 106A, a top end of the dovetail groove 116 is aligned with the dovetail tongue 120A, and the interchangeable backstrap 110B is pulled into the installed position (e.g., illustrated with respect to FIG. 2B).

In some embodiments, modular extender 106A forms part of a magazine well 118. Magazine well 118 may be a cavity to receive a magazine (e.g., a firearm magazine that holds cartridges for firing, etc.). When coupled to the main grip (e.g., main grip 104), the modular extender 106A may extend the length of the magazine well 118. Longer and/or higher capacity magazines may be retained in the extended magazine well 118 formed by the modular extender 106A.

Figure 3B:
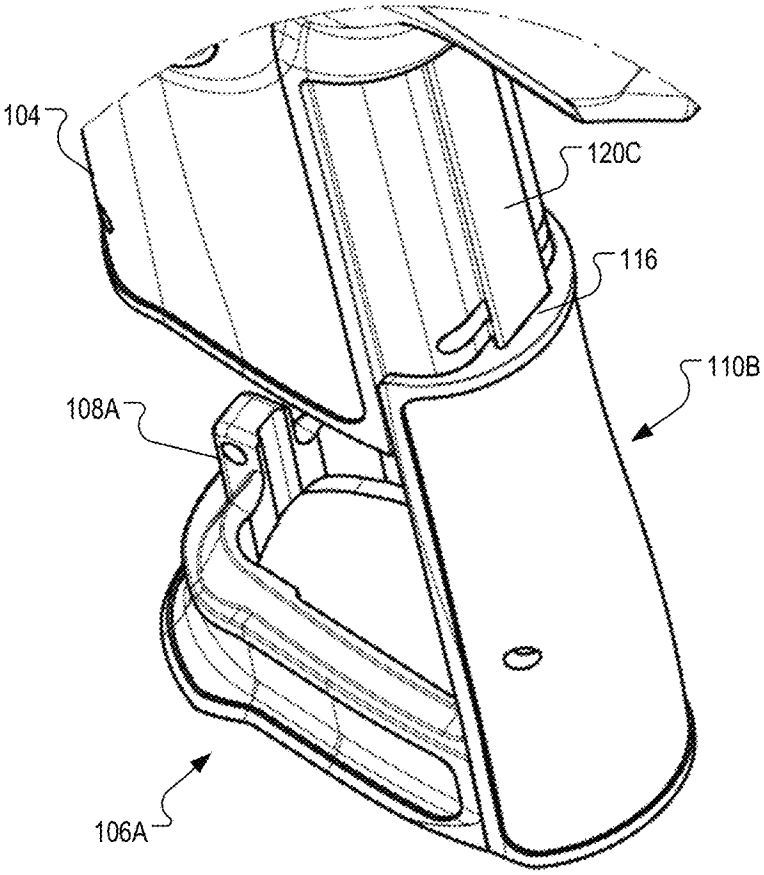
FIGS. 3A-3B illustrate perspective views of a portion of a modular pistol grip assembly, according to certain embodiments.
Figure 3A:
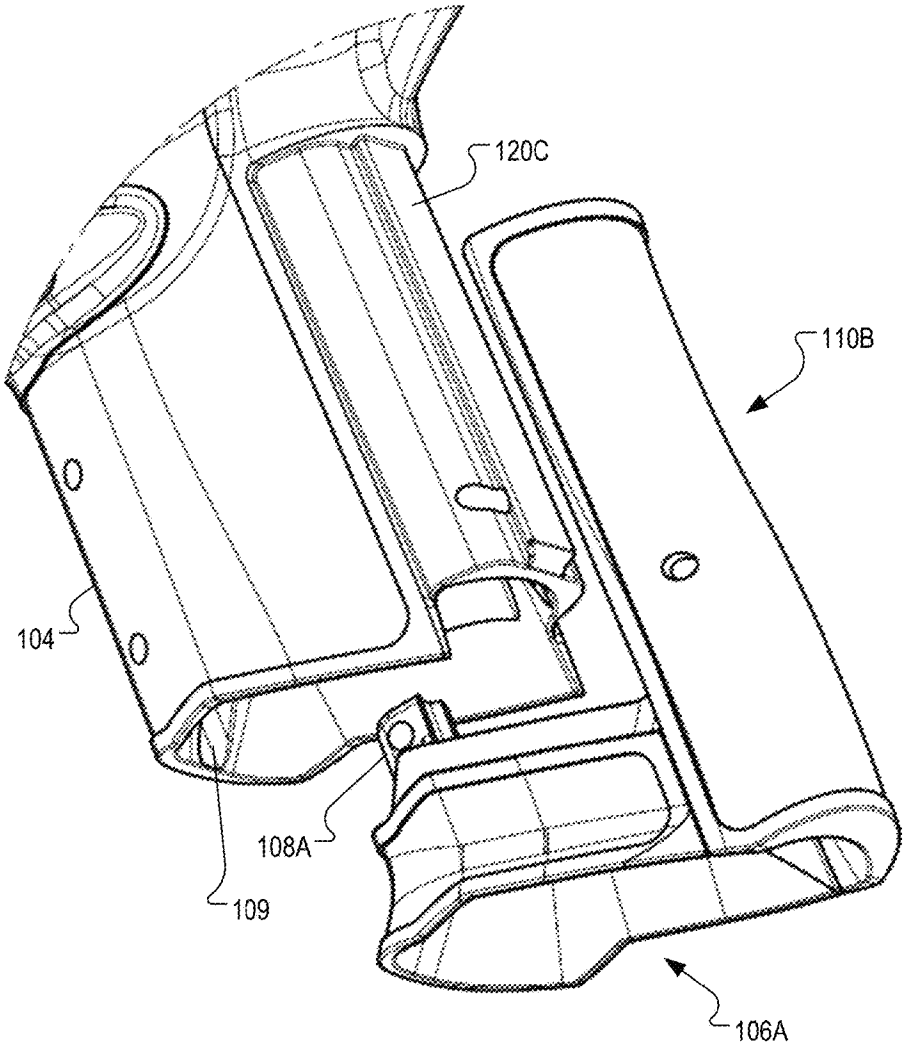

FIGS. 3A-3B illustrate perspective views of a portion of a modular pistol grip assembly, according to certain embodiments. FIG. 3A shows a perspective view of modular extender 106A, interchangeable backstrap 110B, and main grip 104. FIG. 3B shows another perspective view of modular extender 106A, interchangeable backstrap 110B, and main grip 104. In some embodiments, protrusion 108A fits into receptacle 109 formed in the bottom of main grip 104. In some embodiments, protrusion 108A is tapered (e.g., narrower at the top than at the bottom), and receptacle 109 has a corresponding taper so that protrusion 108A locks into receptacle 109. When protrusion 108A locks into receptacle 109, rigidity may be provided between the modular extender 106A and the main grip 104 so that there is substantially no movement of the modular extender 106A relative to the main grip 104, especially during recoil. In some embodiments, modular extender 106A includes a receptacle 109 to receive another protrusion (e.g., protrusion 108B of modular extender 106B shown in FIG. 1).

In some embodiments, to couple the modular extender 106A and/or the interchangeable backstrap 110B to the main grip 104, the dovetail groove 116 is aligned with the dovetail tongue 120C. The interchangeable backstrap 110B (e.g., coupled to the modular extender 106A) is then slid upwards along the dovetail tongue 120C until the interchangeable backstrap 110B and/or the modular extender 106A is in the installed position (e.g., see FIG. 4).

Figure 4:
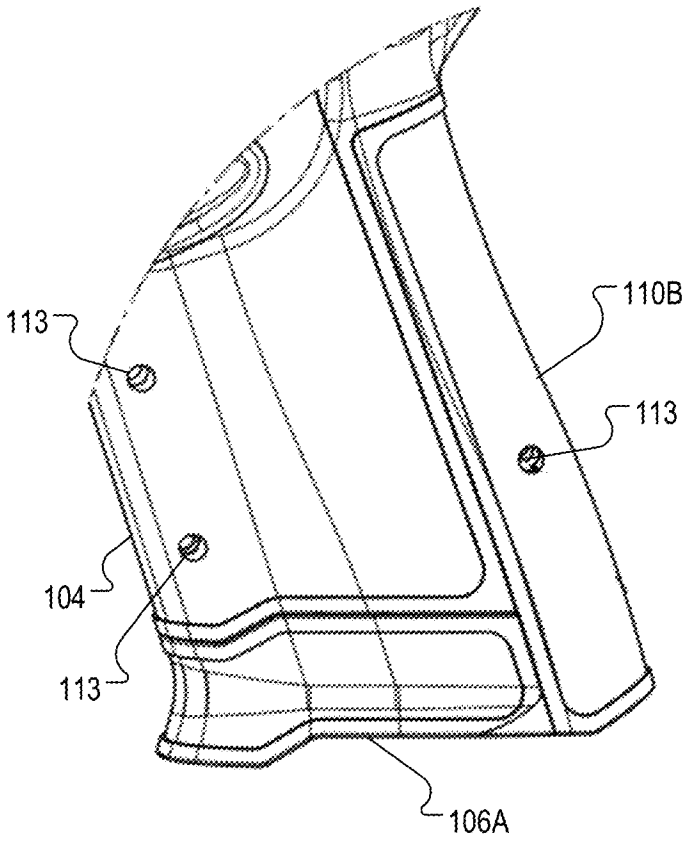
FIG. 4 illustrates a sideview of a portion of an assembled modular pistol grip assembly, according to certain embodiments.

FIG. 4 illustrates a sideview of a portion of an assembled modular pistol grip assembly, according to certain embodiments. As shown in FIG. 4, the modular extender 106A and the interchangeable backstrap 110B are in the installed position on the main grip 104. When the interchangeable backstrap 110B and/or the modular extender 106A are in the installed position on the main grip 104, removable pins (e.g., pins 112) can be installed through the through-holes 113 to removably secure the modular extender 106A and/or the interchangeable backstrap 110B to the main grip 104.

Figure 5:
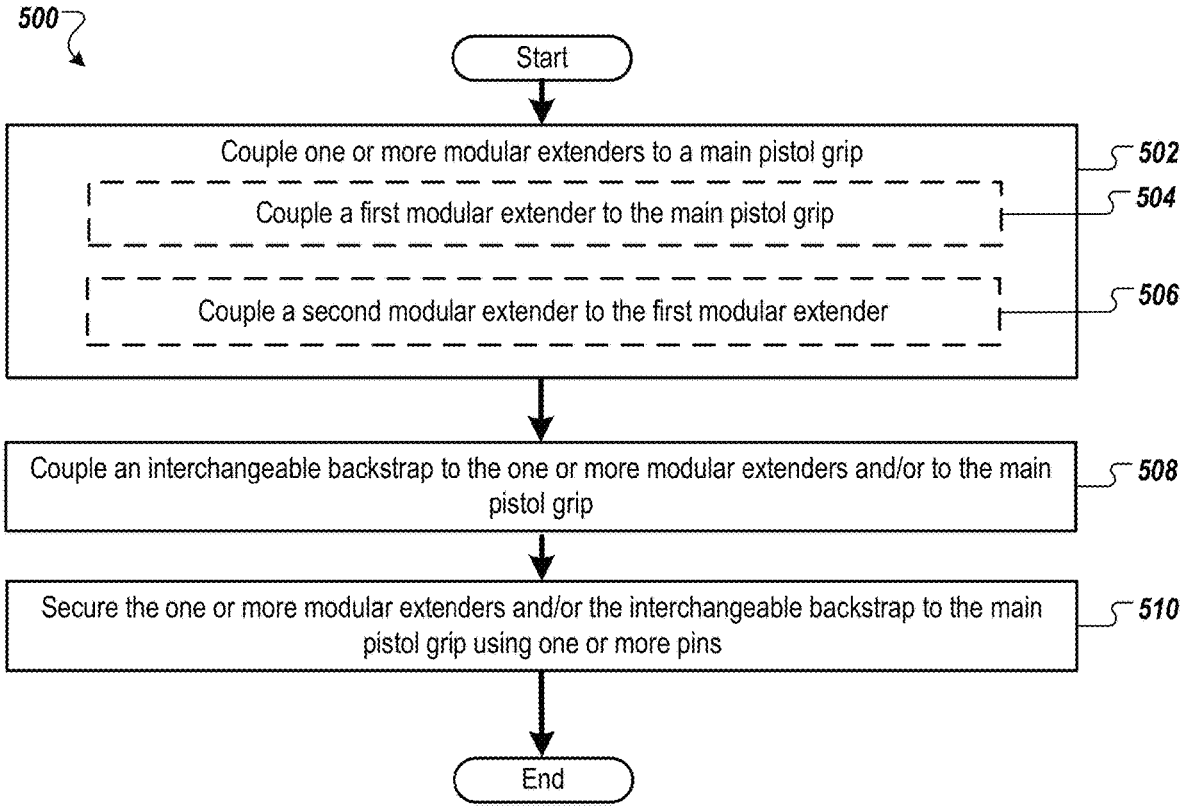
FIG. 5 illustrates a flow diagram of an example method of assembling a modular pistol grip, according to certain embodiments.

FIG. 5 illustrates a flow diagram of an example method 500 of assembling a modular pistol grip, according to certain embodiments. For simplicity of explanation, method 500 is depicted and described as a series of operations. However, operations in accordance with this disclosure can occur in various orders and/or concurrently and with other operations not presented and described herein. Furthermore, in some embodiments, not all illustrated operations are performed to implement method 500 in accordance with the disclosed subject matter. In addition, those skilled in the art will understand and appreciate that method 500 could alternatively be represented as a series of interrelated states via a state diagram or events.

At block 502, in some embodiments, one or more modular extenders are coupled to a main pistol grip. Multiple modular extenders may be coupled together to extend the length of a modular pistol grip. At block 504, in some embodiments, a first modular extender is coupled to the main pistol grip. At block 506, a second modular extender is coupled to the first modular extender. More modular extenders can be coupled to increase the length of the modular pistol grip.

At block 508, in some embodiments, an interchangeable backstrap is coupled to the one or more modular extenders and/or to the main pistol grip. In some embodiments, the interchangeable backstrap is coupled by aligning a dovetail groove formed in a surface of the interchangeable backstrap with one or more first corresponding dovetail tongues of the one or more modular extenders and/or a second corresponding dovetail tongue of the main grip. The interchangeable backstrap may be slid into an installed position along the dovetail tongue and groove arrangement.

At block 510, in some embodiments, the one or more modular extenders and/or the interchangeable backstrap are secured to the main grip using one or more pins. The one or more pins may be driven through one or more through-holes formed in the main grip that align with through-holes formed in the one or more modular extenders and/or the interchangeable backstrap. In some embodiments, one or more fasteners (e.g., mechanical fasteners such as screws, etc.) or adhesives are used to couple the one or more modular extenders and/or the interchangeable backstrap to the main grip.

In some embodiments, the modular pistol grip can be reconfigured using more or fewer modular extenders and/or a longer or shorter interchangeable backstrap to change the length of the modular pistol grip. In some embodiments, the interchangeable backstrap can be replaced with another interchangeable backstrap having a different length and/or a different thickness to change the ergonomics of the modular pistol grip, such as to fit a user's hands, etc.

The preceding description sets forth numerous specific details, such as examples of specific systems, components, methods, and so forth, in order to provide a good understanding of several embodiments of the present disclosure. It will be apparent to one skilled in the art, however, that at least some embodiments of the present disclosure may be practiced without these specific details. In other instances, well-known components or methods are not described in detail or are presented in simple block diagram format in order to avoid unnecessarily obscuring the present disclosure. Thus, the specific details set forth are merely exemplary. Particular implementations may vary from these exemplary details and still be contemplated to be within the scope of the present disclosure.

Reference throughout this specification to "one embodiment" or "an embodiment" means that a particular feature, structure, or characteristic described in connection with the embodiment is included in at least one embodiment. Thus, the appearances of the phrase "in one embodiment" or "in an embodiment" in various places throughout this specification are not necessarily all referring to the same embodiment. In addition, the term "or" is intended to mean an inclusive "or" rather than an exclusive "or." When the term "about," "substantially," or "approximately" is used herein, this is intended to mean that the nominal value presented is precise within ±10%. Also, the terms "first," "second." "third," "fourth," etc., as used herein, are meant as labels to distinguish among different elements and can not necessarily have an ordinal meaning according to their numerical designation.

The terms "over," "under," "between," "disposed on," and "on" as used herein refer to a relative position of one material layer or component with respect to other layers or components. In some examples, one layer disposed on, over, or under another layer may be directly in contact with the other layer or may have one or more intervening layers. Moreover, one layer disposed between two layers may be directly in contact with the two layers or may have one or more intervening layers. Similarly, unless explicitly stated otherwise, one feature disposed between two features may be in direct contact with the adjacent features or may have one or more intervening layers.

Although the operations of the methods herein are shown and described in a particular order, the order of the operations of each method may be altered so that certain operations may be performed in an inverse order or so that certain operations may be performed, at least in part, concurrently with other operations. In another embodiment, instructions or sub-operations of distinct operations may be in an intermittent and/or alternating manner. In one embodiment, multiple metal bonding operations are performed as a single step.

It is to be understood that the above description is intended to be illustrative, and not restrictive. Many other embodiments will be apparent to those of skill in the art upon reading and understanding the above description. The scope of the disclosure should, therefore, be determined with reference to the appended claims, along with the full scope of equivalents to which each claim is entitled.

What is claimed is:

1. A modular pistol grip, comprising:

one or more modular extenders configured to removably couple to a main grip; and a first backstrap configured to removably couple to the main grip and further configured to removably couple to the one or more modular extenders, wherein the first backstrap is interchangeable with one or more different second backstraps.

2. The modular pistol grip of claim 1, wherein the one or more modular extenders are configured to extend a length of the modular pistol grip when removably coupled to the main grip.

3. The modular pistol grip of claim 2, wherein the first backstrap or the second backstrap has an associated length with respect to an extended length of the modular pistol grip.

4. The modular pistol grip of claim 1, wherein a first modular extender of the one or more modular extenders is configured to receive a second modular extender of the one or more modular extenders.

5. The modular pistol grip of claim 4, wherein the main grip comprises a first female receptacle to receive a first male protrusion of the first modular extender, and wherein the first modular extender comprises a second female receptacle to receive a second male protrusion of the second modular extender.

6. The modular pistol grip of claim 1, wherein the one or more modular extenders comprise a cavity to receive a firearm magazine configured to removably couple to the main grip.

7. The modular pistol grip of claim 1, wherein the first backstrap forms a dovetail groove along a length of the first backstrap to receive one or more corresponding dovetail tongues of one or more of the one or more modular extenders or the main grip.

8. The modular pistol grip of claim 1, wherein at least one of the one or more modular extenders, the first backstrap or the second backstrap comprises a polymer material.

9. The modular pistol grip of claim 1, further comprising:

one or more first removable pins to secure the one or more modular extenders to the main grip; and one or more second removable pins to secure the first backstrap to one or more of the one or more modular extenders or the main grip.

10. The modular pistol grip of claim 1, wherein the first backstrap has a first thickness, and wherein the second backstrap has a second thickness.

11. A pistol grip, comprising:

a first modular extender configured to removably couple to a main grip; and a first backstrap configured to removably couple to the main grip and further configured to removably couple to the first modular extender, wherein the first backstrap is interchangeable with a second backstrap.

12. The pistol grip of claim 11, further comprising a second modular extender removably coupled to the first modular extender, wherein the first modular extender and the second modular extender are configured to extend a length of the pistol grip when removably coupled to the main grip.

13. The pistol grip of claim 12, wherein the first modular extender comprises a female receptacle to receive a male protrusion of the second modular extender.

14. The pistol grip of claim 11, wherein the first backstrap forms a dovetail groove along a length of the first backstrap to receive one or more of a first corresponding dovetail tongue of the first modular extender or a second corresponding dovetail tongue of the main grip.

15. The pistol grip of claim 11, wherein the first modular extender comprises a cavity to receive a firearm magazine configured to removably couple to the main grip.

16. A firearm, comprising:

a frame; and a modular grip coupled to the frame, wherein the modular grip comprises:

one or more modular grip extensions configured to removably couple to a main portion of the modular grip; and a backstrap portion configured to removably couple to the main portion of the modular grip and further configured to removably couple to the one or more modular grip extensions.

17. The firearm of claim 16, wherein the one or more modular grip extensions are configured to extend a length of the modular grip when removably coupled to the main portion.

18. The firearm of claim 16, wherein the main portion comprises a first female receptacle to receive a first male protrusion of a first modular grip extension of the one or more modular grip extensions, and wherein the first modular grip extension comprises a second female receptacle to receive a second male protrusion of a second modular grip extension of the one or more modular grip extensions.

19. The firearm of claim 16, wherein the backstrap portion forms a dovetail groove along a length of the backstrap portion to receive one or more corresponding dovetail tongues of one or more of the one or more modular grip extensions or the main portion of the modular grip.

20. The firearm of claim 16, wherein the backstrap portion comprises a first backstrap having a first length or a first thickness, wherein the first backstrap is interchangeable with a second backstrap having a second length or a second thickness.

* * * * *